US009218774B2

(12) United States Patent
Huang

(10) Patent No.: US 9,218,774 B2
(45) Date of Patent: Dec. 22, 2015

(54) DRIVING SYSTEM FOR LCD APPARATUS AND METHOD THEREOF

(75) Inventor: Shunming Huang, Qingdao (CN)

(73) Assignee: HISENSE HIVIEW TECH CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 14/115,097

(22) PCT Filed: May 3, 2012

(86) PCT No.: PCT/CN2012/075026

§ 371 (c)(1),
(2), (4) Date: Jan. 21, 2014

(87) PCT Pub. No.: WO2013/143203

PCT Pub. Date: Oct. 3, 2013

(65) Prior Publication Data

US 2014/0125710 A1 May 8, 2014

(30) Foreign Application Priority Data

Mar. 31, 2012 (CN) ..... 2012 1 0092304

(51) Int. Cl.
*G09G 3/36* (2006.01)

(52) U.S. Cl.
CPC ..... *G09G 3/3607* (2013.01); *G09G 3/3688* (2013.01); *G09G 3/3614* (2013.01)

(58) Field of Classification Search
CPC .. G09G 3/3607; G09G 3/3614; G09G 3/3688
See application file for complete search history.

(56) References Cited

U.S. PATENT DOCUMENTS

| | | | | |
|---|---|---|---|---|
| 7,042,430 | B2 * | 5/2006 | Isami et al. | 345/690 |
| 7,187,392 | B2 * | 3/2007 | Ito | 345/690 |
| 7,423,661 | B2 * | 9/2008 | Abe et al. | 345/690 |
| 7,692,644 | B2 * | 4/2010 | Eriguchi et al. | 345/212 |
| 7,719,509 | B2 * | 5/2010 | Tanaka | 345/99 |
| 7,973,973 | B2 * | 7/2011 | Nose et al. | 358/3.01 |
| 8,013,818 | B2 * | 9/2011 | You | 345/87 |

(Continued)

FOREIGN PATENT DOCUMENTS

| | | | |
|---|---|---|---|
| CN | 1639616 | A | 7/2005 |
| CN | 201130518 | Y | 10/2008 |

(Continued)

*Primary Examiner* — Andrew Sasinowski
(74) *Attorney, Agent, or Firm* — Cheng-Ju Chiang

(57) ABSTRACT

A driving system for a liquid crystal display apparatus and a method thereof are provided, the driving system comprises a data-latching circuit, a synchronous-signal separating module, a vertical synchronous-signal discriminator, a vertical synchronous-signal counter, a horizontal synchronous-signal discriminator, a data operator and a polarity-signal generator. The vertical synchronous-signal discriminator outputs a start signal to the polarity-signal generator when vertical synchronous signals exist. The vertical synchronous-signal counter accumulates an amount of the vertical synchronous signals, and outputs an accumulated result to the data operator. The horizontal synchronous-signal discriminator sends the start signal to the data operator. The data operator subtracts odd sub-pixel data from even sub-pixel data of RGB data in a horizontal line or subtracts the even sub-pixel date from the odd sub-pixel date to obtain an Msum value, and controls the polarity-signal generator output polar-controlling signals to scan lines according to the Msum value and the accumulated result.

17 Claims, 5 Drawing Sheets

(56) References Cited

U.S. PATENT DOCUMENTS

| | | | | |
|---|---|---|---|---|
| 8,054,266 | B2 * | 11/2011 | Woo et al. | 345/89 |
| 8,144,113 | B2 * | 3/2012 | Park et al. | 345/102 |
| 8,144,138 | B2 * | 3/2012 | Kim et al. | 345/204 |

FOREIGN PATENT DOCUMENTS

| | | | |
|---|---|---|---|
| CN | 101325047 | A | 12/2008 |
| CN | 101577091 | A | 11/2009 |

* cited by examiner

| R | G | B | R | G | B | R | G | B | R | G | B | | K=0 | K=1 |
|---|---|---|---|---|---|---|---|---|---|---|---|---|---|---|
| 255 | 0 | 255 | 0 | 255 | 0 | 255 | 0 | 255 | 0 | 255 | 0 | Msum=1530>0 | POL=H | POL=L |
| 255 | 0 | 255 | 0 | 255 | 0 | 255 | 0 | 255 | 0 | 255 | 0 | Msum=1530>0 | POL=H | POL=L |
| 255 | 0 | 255 | 0 | 255 | 0 | 255 | 0 | 255 | 0 | 255 | 0 | Msum=1530>0 | POL=H | POL=L |
| 255 | 0 | 255 | 0 | 255 | 0 | 255 | 0 | 255 | 0 | 255 | 0 | Msum=1530>0 | POL=H | POL=L |

M>0

FIG. 6

| R | G | B | R | G | B | R | G | B | R | G | B | | K=0 | K=1 |
|---|---|---|---|---|---|---|---|---|---|---|---|---|---|---|
| 255 | 255 | 255 | 255 | 255 | 255 | 255 | 255 | 255 | 255 | 255 | 255 | Msum=0 | POL=H | POL=L |
| 255 | 255 | 255 | 255 | 255 | 255 | 255 | 255 | 255 | 255 | 255 | 255 | Msum=0 | POL=L | POL=H |
| 255 | 255 | 255 | 255 | 255 | 255 | 255 | 255 | 255 | 255 | 255 | 255 | Msum=0 | POL=H | POL=L |
| 255 | 255 | 255 | 255 | 255 | 255 | 255 | 255 | 255 | 255 | 255 | 255 | Msum=0 | POL=L | POL=H |

M=0

FIG. 7

| R | G | B | R | G | B | R | G | B | R | G | B | | K=0 | K=1 |
|---|---|---|---|---|---|---|---|---|---|---|---|---|---|---|
| 0 | 255 | 0 | 255 | 0 | 255 | 0 | 255 | 0 | 255 | 0 | 255 | Msum=-1530<0 | POL=L | POL=H |
| 0 | 255 | 0 | 255 | 0 | 255 | 0 | 255 | 0 | 255 | 0 | 255 | Msum=-1530<0 | POL=L | POL=H |
| 0 | 255 | 0 | 255 | 0 | 255 | 0 | 255 | 0 | 255 | 0 | 255 | Msum=-1530<0 | POL=L | POL=H |
| 0 | 255 | 0 | 255 | 0 | 255 | 0 | 255 | 0 | 255 | 0 | 255 | Msum=-1530<0 | POL=L | POL=H |

M<0

FIG. 8

| R | G | B | R | G | B | R | G | B | R | G | B | | K=0 | K=1 |
|---|---|---|---|---|---|---|---|---|---|---|---|---|---|---|
| 0 | 255 | 0 | 255 | 0 | 255 | 0 | 255 | 0 | 255 | 0 | 255 | Msum=-1530<0 | POL=L | POL=H |
| 200 | 100 | 200 | 250 | 200 | 250 | 200 | 250 | 250 | 200 | 60 | 60 | Msum=0 | POL=H | POL=L |
| 200 | 100 | 80 | 120 | 10 | 60 | 180 | 200 | 120 | 100 | 250 | 20 | Msum=240>0 | POL=H | POL=L |
| 0 | 255 | 0 | 255 | 0 | 255 | 0 | 255 | 0 | 255 | 0 | 10 | Msum=-1285<0 | POL=L | POL=H |

FIG. 9

DRIVING SYSTEM FOR LCD APPARATUS AND METHOD THEREOF

The present application is a 35 U.S.C. §371 National Phase conversion of International (PCT) Patent Application No. PCT/CN2012/075026, filed on May 3, 2012, the disclosure of which is incorporated by reference herein. The PCT International Patent Application was filed and published in Chinese.

FIELD

The present invention relates to a driving system for LCD apparatus and a driving method thereof, and more particularly to the driving system for the LCD apparatus and the method thereof employing a thin-film transistor (TFT) to control transmission signals.

BACKGROUND

Nowadays, the liquid crystal displays (LCDs) is widely used in various fields, and is closely related to our lives. Generally, the LCDs comprise a first substrate having a common electrode, a second substrate, and a liquid crystal layer which is between the first substrate and the second substrate. A plurality of pixels is formed on the second substrate, and each pixel comprises a pixels electrode and a thin film transistor (TFT). Material of the common electrode generally used for indium tin oxides (ITOs). Voltage is applied to the pixels electrode and the common electrode, for reorienting the liquid crystal molecules of the liquid crystal layer, so as to control amount of the light transmitting through the liquid crystal layer. The TFT is configured for controlling signals transmitted to a corresponding the pixels electrode.

Because impedance of the ITO of the LCDs and capacitance of an LCD panel (Cell) are larger, the LCDs have a crosstalk problem. Especially, left and right part of middle pattern of screen exist a crosstalk phenomenon, so as to color of the middle pattern is different from other parts of the screen, and screen of the LCDS has a color cast problem when detecting the screen of the LCDS. Generally, a feedback manner is used for compensation to improve the crosstalk phenomenon, common voltage of TFT (VCOM_TFT) of the LCD panel is used as a feedback signals source to compensate for negative feedback. However, the conventional manner compensates once every one gate, the common voltage (VCOM) frequent switching, and if the LCD displays some special pattern, the common voltage has large current, such that temperature of circuit board (IC) on the operational amplifier (OP) is high, affecting the quality of products.

SUMMARY

Therefore, the present invention relates to a driving system for liquid crystal display (LCD) apparatus which can reduce heating of a driving panel.

The present invention also relates to a driving method for LCD apparatus employing the driving system.

The present invention provides the driving system for the LCD apparatus, which comprises a data-latching circuit, a synchronous-signal separating module, a vertical synchronous-signal discriminator, a vertical synchronous-signal counter, horizontal synchronous-signal discriminator, a data operator and a polarity-signal generator. The data-latching circuit separates input signals into RGB data and data-enable signals. The synchronous-signal separating module converts the data-enable signals into vertical synchronous signals and horizontal synchronous signals. The vertical synchronous-signal discriminator sends out a start signal to the polarity-signal generator when the vertical synchronous-signal discriminator judges vertical synchronous signals exist. The vertical synchronous-signal counter accumulates an amount of the vertical synchronous signals and sending out an accumulated result to the data operator. The horizontal synchronous-signal discriminator sends out a start signal to the data operator when the horizontal synchronous-signal discriminator judges horizontal synchronous signals exist. The data operator starts to operate after receiving the start signal sent out from the horizontal synchronous-signal discriminator, subtracts data of odd sub-pixels by data of even sub-pixels which are arranged in a horizontal line of the RGB data or subtracts data of the even sub-pixels by the odd sub-pixels, to obtain an Msum value, and then controls the polarity-signal generator to output polar-controlling signals corresponding to a scan line according to the Msum value and the accumulated result of the vertical synchronous-signal counter accumulating the amount of the vertical synchronous signals.

In an exemplary embodiment of the present invention, an input terminal of the horizontal synchronous-signal discriminator is electrically coupled to the synchronous-signal separating module through the vertical synchronous-signal counter and the vertical synchronous-signal discriminator, and an output terminal thereof is electrically coupled to the data operator; an output terminal of the vertical synchronous-signal counter electrically coupled to the data operator through the horizontal synchronous-signal discriminator.

In an exemplary embodiment of the present invention, an input terminal of the horizontal synchronous-signal discriminator is electrically coupled to the synchronous-signal separating module through the vertical synchronous-signal counter and the vertical synchronous-signal discriminator, and an output terminal thereof is electrically coupled to the data operator; an output terminal of the vertical synchronous-signal counter directly coupled to the data operator.

In an exemplary embodiment of the present invention, an input terminal of the horizontal synchronous-signal discriminator is directly coupled to the synchronous-signal separating module, and an output thereof is directly coupled to the data operator; an output terminal of the vertical synchronous-signal counter is directly coupled to the data operator.

In an exemplary embodiment of the present invention, the Vertical synchronous-signal counter accumulated in binary.

The present invention also provides a driving method for a liquid crystal display (LCD) apparatus, which comprises steps of:

(1) employing a data-latching circuit latching an input signals and separating the input signals into an RGB data and data-enable signals;

(2) a synchronous-signal separating module converting the data-enable signals into vertical synchronous signals and horizontal synchronous signals;

(3) employing a vertical synchronous-signal discriminator determining whether vertical synchronous signals exist, and when the vertical synchronous-signal discriminator judges the vertical synchronous signals exist, then to step (4), otherwise return to step (1);

(4) the polarity-signal generator starting to work, and employing a vertical synchronous-signal counter accumulating an amount of the vertical synchronous signals, $K=K+1$;

(5) employing horizontal synchronous-signal discriminator determining whether horizontal synchronous signals exist, when the horizontal synchronous-signal discriminator judges the vertical synchronous signals exist, then performing step (6), otherwise return to perform step (2);

(6) a data operator starting to work, to subtract data of odd sub-pixels by data of even sub-pixels which are arranged in a horizontal line of the RGB data or subtracts data of the even sub-pixels by the odd sub-pixels, to obtain an Msum value, and determining a polarity of corresponding scan lines according the Msum value and K.

(7) employing a polarity-signal generator outputting polar-controlling signals according to a determination result of the data operator.

In an exemplary embodiment of the present invention, the vertical synchronous-signal counter accumulates in binary.

In an exemplary embodiment of the present invention, When Msum<0, K=0, the polar-controlling signals are logic low; when Msum<0, K≠0, the polar-controlling signals are logic high; when Msum>0, K=0, the polar-controlling signals are logic high; when Msum>0, K≠0, the polar-controlling signals are logic low; when Msum=0, K=0, polarity of the polar-controlling signals of a scan line is opposite with the polarity of the polar-controlling signals a previous scan line.

In an exemplary embodiment of the present invention, wherein positive voltage is applied to the odd sub-pixels, the negative voltage is applied to the even sub-pixels, and the data operator subtracts data of even sub-pixels by data of odd sub-pixels which are arranged in a horizontal line of the RGB data to obtain the Mn value, and compare the Msum value with zero to determine whether polarity of a scan line and polarity of a next scan line is the same, if the polarity of the scan line and the polarity of the next scan line is the same, the positive voltage is applied to the even sub-pixels, the negative voltage is applied to the odd sub-pixels, and if the polarity of the scan line and the polarity of the next scan line is different, the negative voltage is applied to the even sub-pixels, the positive voltage is applied to the even sub-pixels.

In an exemplary embodiment of the present invention, when the data operator accumulates the Msum value, the data operator substrates data of even sub-pixels by data of odd sub-pixels of inputting two pixels to obtain an Mn value, then adds up the Mn value in a horizontal line to obtain the Msum value; wherein n represents the times for transmitting data.

In an exemplary embodiment of the present invention, positive voltage is applied to the even sub-pixels, the negative voltage is applied to the odd sub-pixels, and the data operator subtracts data of even sub-pixels by data of odd sub-pixels which are arranged in a horizontal line of the RGB data to obtain the Mn value, and compare the Msum value with zero to determine whether polarity of a scan line and polarity of a next scan line is the same, if the polarity of the scan line and the polarity of the next scan line is the same, the negative voltage is applied to the even sub-pixels, the positive voltage is applied to the odd sub-pixels, and if the polarity of the scan line and the polarity of the next scan line is different, the positive voltage is applied to the even sub-pixels, the negative voltage is applied to the even sub-pixels.

In an exemplary embodiment of the present invention, when the data operator accumulates the Msum value, the data operator substrates data of even sub-pixels by data of odd sub-pixels of inputting two pixels to obtain the Mn value, then adds up the Mn value in a horizontal line to obtain the Msum value; wherein n represents the times for transmitting data.

A driving system for liquid crystal display (LCD) apparatus, which comprises:

a data-latching circuit, the data-latching circuit being configured for separating input signals into RGB data and an data-enable signals;

a synchronous-signal separating module, the synchronous-signal separating module electrically coupled to the data-latching circuit, to convert the data-enable signals into vertical synchronous signals and horizontal synchronous signals;

a vertical synchronous-signal discriminator, the vertical synchronous-signal discriminator electrically coupled to the synchronous-signal separating module, to determine whether the vertical synchronous signals exist;

a vertical synchronous-signal counter, the vertical synchronous-signal counter electrically coupled to the vertical synchronous-signal discriminator, to accumulate an amount of the vertical synchronous signals and send out an accumulated result to the data operator;

a horizontal synchronous-signal discriminator, the horizontal synchronous-signal discriminator is configured for determining whether the horizontal synchronous signals exist, and sending out a start signal when the vertical synchronous-signal discriminator;

a data operator, the data operator being electrically coupled to the horizontal synchronous-signal discriminator, starting to operate after receiving the start signal sent out from the horizontal synchronous-signal discriminator, and subtracting data of odd sub-pixels by data of even sub-pixels which are arranged in a horizontal line of the RGB data or subtracts data of the even sub-pixels by the odd sub-pixels, to obtain an Msum value, and then determining polarity of corresponding a scan line according to the Msum value and the accumulated result of the vertical synchronous-signal counter accumulating the amount of the vertical synchronous signals.

a polarity-signal generator, the polarity-signal generator electrically coupled to the data operator, to output polar-controlling signals according to the determination result of the data operator.

In an exemplary embodiment of the present invention, the horizontal synchronous signals is sent out from the synchronous-signal separating module through the vertical synchronous-signal discriminator and the vertical synchronous-signal counter to the horizontal synchronous-signal discriminator, and the accumulated result of the vertical synchronous-signal counter accumulating the amount of the vertical synchronous signals is sent out from the horizontal synchronous-signal discriminator to the data operator.

In an exemplary embodiment of the present invention, the accumulated result of the vertical synchronous-signal counter accumulating the amount of the vertical synchronous signals is directly sent out to the data operator.

In an exemplary embodiment of the present invention, the horizontal synchronous signals are directly sent out from the synchronous-signal separating module to the horizontal synchronous-signal discriminator, and the accumulated result of the vertical synchronous-signal counter accumulating the amount of the vertical synchronous signals is sent out from the horizontal synchronous-signal discriminator to the data operator.

In an exemplary embodiment of the present invention, the vertical synchronous-signal counter accumulates in binary.

In summary, the liquid crystal display (LCD) driving system and the LCD driving method of the present invention may employ the data-latching circuit latches the input signals and separating the RGB data and the data-enable signals from the input signals. The synchronous-signal separating module converts the data-enable signals into the vertical synchronous signals and the horizontal synchronous signals. The vertical synchronous-signal discriminator generates the start signal to the polarity-signal generator when the vertical synchronous-signal discriminator judges the vertical synchronous signals exist. The data operator starts to operate after receiving the start signal sent out from the horizontal synchronous-signal discriminator, subtracts data of odd sub-pixels by data of even sub-pixels which are arranged in a horizontal line of the RGB data or subtracts data of the even sub-pixels by the odd sub-pixels, to obtain the Msum value, and then controls the polarity-signal generator to output polar-controlling signals corresponding to a scan line according to the Msum value and the accumulated result of the vertical synchronous-signal counter accumulating the amount of the vertical synchronous signals. The polarity-signal generator starts to operate after receiving the start signal sent out from the vertical synchronizing discriminator, and sends out the polar-controlling signals according to a determination result of the data operator. The Msum value reflects sum deviation of data of entire scan line, which affects amounts of the entry line deviation from positive and negative polarity, and the Msum value is greater the sum deviation is more. Compare the Msum value with zero to determine whether polarity of a scan line and polarity of a next scan line is the same. If the polarity of the scan line and the polarity of the next scan line is the same, keeping the same, and if the polarity of the scan line and the polarity of the next scan line is different, making the polarity of the scan line and the polarity of the next scan line is the same, so that output of the data operation is not frequent switching polarity of positive and negative current, which reduces heat from source.

The above objects and advantages of the present invention will become more readily apparent to those ordinarily skilled in the art after reviewing the following detailed description and accompanying drawings.

BRIEF DESCRIPTION OF THE DRAWINGS

FIG. 6 is a judging view of polar-controlling signals POL when Msum>0.

FIG. 7 is a judging view of polar-controlling signals POL when Msum=0.

FIG. 8 is a judging view of polar-controlling signals POL when Msum<0.

FIG. 9 is a judging view of polar-controlling signals POL when Msum>0, Msum=0 and Msum<0 in a picture frame.

DETAILED DESCRIPTION OF PREFERRED EMBODIMENTS

A First Exemplary Embodiment

Figure 1:
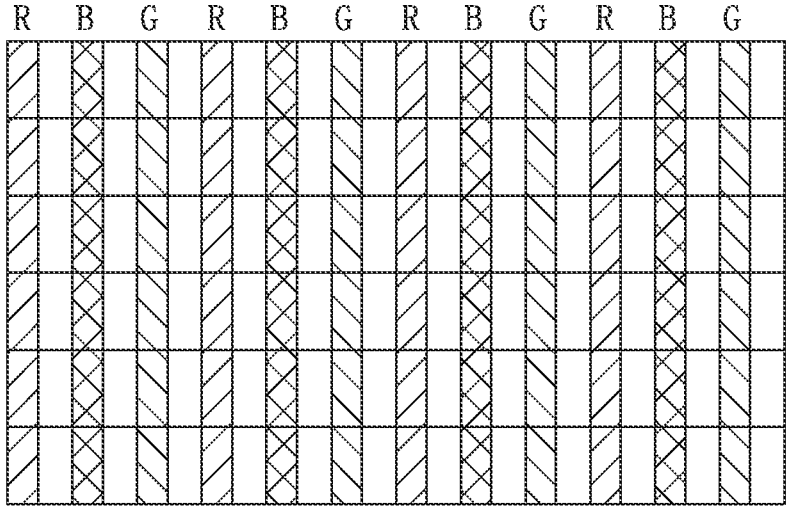
FIG. 1 is a view of a picture frame.

FIG. 1 is a picture frame. The testing picture is a matrix of red (R) pixels, green (G) pixels and blue (B) pixels. In the exemplary embodiment, even pixels are driven by positive voltages, and odd pixels are driven by negative voltages.

Figure 2:
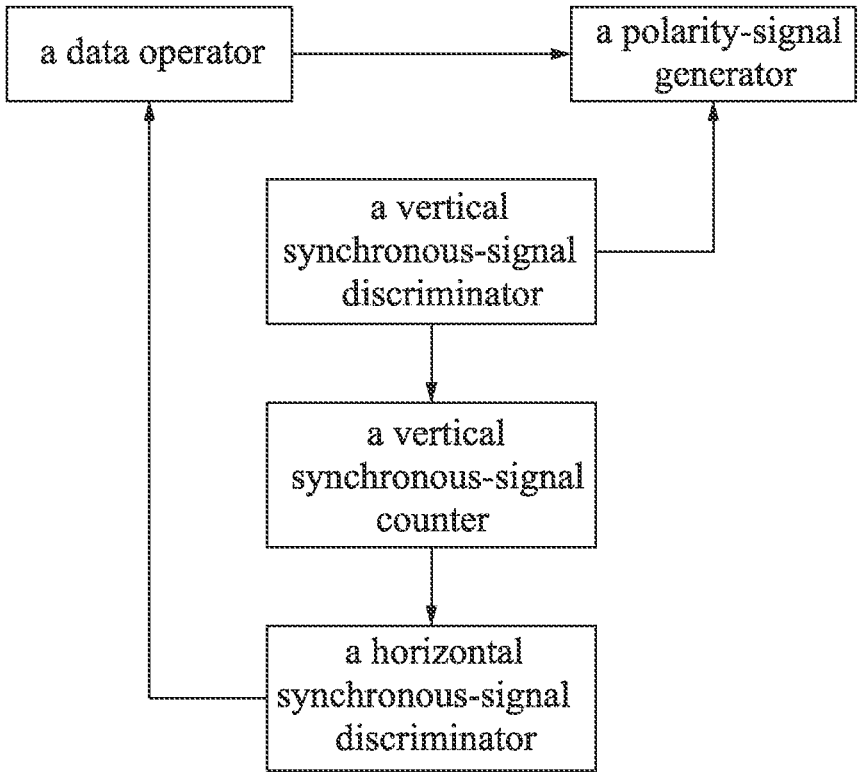
FIG. 2 is a schematic view of a driving system for liquid crystal display in accordance with a first exemplary embodiment of the present invention.

Referring to FIG. 2, a driving system for liquid crystal display (LCD) apparatus in accordance with the first exemplary embodiment of the present invention, comprises a data-latching circuit, a synchronous-signal separating module, a data operator, a vertical synchronous-signal discriminator, a vertical synchronous-signal counter, horizontal synchronous-signal discriminator, and a polarity-signal generator.

The data-latching circuit latches input data, and separates the input data to RGB data signals and data-enable (DE) control signals. An output terminal of the data-latching circuit is electrically coupled to the data operator and the synchronous-signal separating module, and sends the RGB signals and the DE control signals corresponding to the data operator and the synchronous-signal separating module.

The synchronous-signal separating module convers the data DE control signals into horizontal synchronous signals and vertical synchronous signals. An output of the synchronous-signal separating module is electrically coupled to the horizontal synchronous-signal discriminator, to send converted signals to the horizontal synchronous-signal discriminator.

The vertical synchronous-signal discriminator receives the converted signals sent out from the synchronous-signal separating module, and determines whether the vertical synchronous signals exist. An output of the vertical synchronous-signal discriminator is electrically coupled to the polarity-signal generator, and other output of the vertical synchronous-signal discriminator is electrically coupled to the vertical synchronous-signal counter. In an exemplary embodiment of the present invention, the vertical synchronous-signal discriminator is equal to a switch to connect the synchronous-signal separating module and the synchronous-signal counter. The synchronous-signal separating module is electrically coupled to the synchronous-signal counter, and data of the synchronous-signal separating module is sent to the synchronous-signal counter when the converted signals are vertical synchronous signals. The vertical synchronizing discriminator sends a start signal to the polarity-signal generator, and the polarity-signal generator starts to operate when the converted signals are vertical synchronous signals.

The vertical synchronous-signal counter receives the converted signals sent out from the vertical synchronous-signal discrimination, and accumulates an amount of the vertical synchronous signals K in binary. K value is equal to K+1, and the K value is zero or one in turn. An output terminal is electrically coupled to the horizontal synchronous-signal discriminator, to send the amounted result and the horizontal synchronous signals to the horizontal synchronous-signal discriminator.

The horizontal synchronous-signal discriminator receives signals sent from the vertical synchronous-signal counter, and determines whether the horizontal synchronous signals exist. An output terminal of the horizontal synchronous-signal counter is electrically coupled to the data operator. The horizontal synchronous-signal discriminator sends the K value and the start signal to data operator when the horizontal synchronous-signal discriminator judges the horizontal synchronous signals exist.

In an exemplary embodiment of the present invention, an input terminal of the horizontal synchronous-signal discriminator is electrically coupled to the synchronous-signal separator module through the vertical synchronous-signal counter and the vertical synchronous-signal discriminator, and an output terminal of the vertical synchronous-signal discriminator is electrically coupled to the data operator through the horizontal synchronous-signal discriminator. The horizontal synchronous signals are sent from the synchronous-signal separator module to the horizontal synchronous-signal discriminator through vertical synchronous-signal discriminator and vertical synchronous-signal counter. The vertical synchronous-signal counter accumulates an amount of the vertical synchronous signals, and sends an accumulated result to the data operator through the horizontal synchronous-signal discriminator.

When the data operator is receiving the start signal sent out from the horizontal synchronizing discriminator, the data operator starts to operate and discriminant. The data operator subtracts an odd sub-pixels data from an even sub-pixels data of an RGB data in a horizontal line to obtain an Msum value. When transmitting the RGB data, the data for two pixels are incoming once. Therefore, when employing the data operator to calculate the Msum value, it may firstly obtain an Mn value by subtracting the data of odd sub-pixels by the data of even sub-pixels of the two pixels once of the two pixels once, Mn=DRn1−DGn1+DBn1−DRn2+DGn2−DBn2, and then add up the Mn value in the same horizontal line to obtain the Msum value, Msum=M1+M2+ . . . +Mn, n represents the times for transmitting data, n1 and n2 are corresponding to a first pixels and a second pixels of the data transmitted for the n times, DRn1 is a data value of the red pixels of n1 pixels, DGn1 is a data value of the green pixels of n1 pixels, DBn1 is a data value of the blue pixels of n1 pixels. Then, the Mn values in a horizontal line are added up, to obtain the Msum value. The data operator compares the Msum value to 0, and controls the polarity-signal generator generate polar-controlling signals POL according to comparison result of the Msum value and 0, and the K.

As shown in FIG. 6, polarity of the polar-controlling signals POL is logic high when Msum>0 and K=0. The polarity of the polar-controlling signals POL is logic low when Msum>0 and K≠0.

As shown in FIG. 7, the polarity of the polar-controlling signals POL of the scan line and the polarity of the polar-controlling signals POL of a prior scan line is converse.

As shown in FIG. 8, the polarity of the polar-controlling signals POL is logic low when Msum<0 and K=0. The polarity of the polar-controlling signals POL is logic high when Msum<0 and K≠0.

FIG. 9 shows a situation when Msum>0, Msum=0 and Msum<0 in frame picture.

Above calculations about the Msum value are based on an assumption that a positive voltage is applied to the even sub-pixels, a negative voltage is applied to the odd sub-pixels. The Msum value reflects sum deviation of data of entire scan line, which affects amounts of the entry line deviation from positive and negative polarity, and the Msum value is greater the sum deviation is more. Compare the Msum value with zero to determine whether polarity of a scan line and polarity of a next scan line is the same. If the polarity of the scan line and the polarity of the next scan line is the same, a positive voltage is applied to the even sub-pixels, a negative voltage is applied to the odd sub-pixels, and if the polarity of the scan line and the polarity of the next scan line is different, a negative voltage is applied to the even sub-pixels, a positive voltage is applied to the even sub-pixels to make the polarity of the scan line same as the polarity of the next scan line, so that output of the data operation is not frequent switching polarity of positive and negative current, which reduces heat from source.

Certainly, The assumption also can be that the positive voltage is applied to the even sub-pixels, the negative voltage is applied to the odd sub-pixels, and subtract data of odd sub-pixels by data of even sub-pixels which are arranged in a horizontal line of the RGB data to obtain the Mn value. Compare the Msum value with zero to determine whether the polarity of a scan line and polarity of a next scan line is the same. If the polarity of the scan line and the polarity of the next scan line is the same, the negative voltage is applied to the even sub-pixels, the positive voltage is applied to the odd sub-pixels, and if the polarity of the scan line and the polarity of the next scan line is different, the positive voltage is applied to the even sub-pixels, the negative voltage is applied to the even sub-pixels to make the polarity of the scan line as same as the polarity of the next scan line.

A Second Exemplary Embodiment

Figure 3:
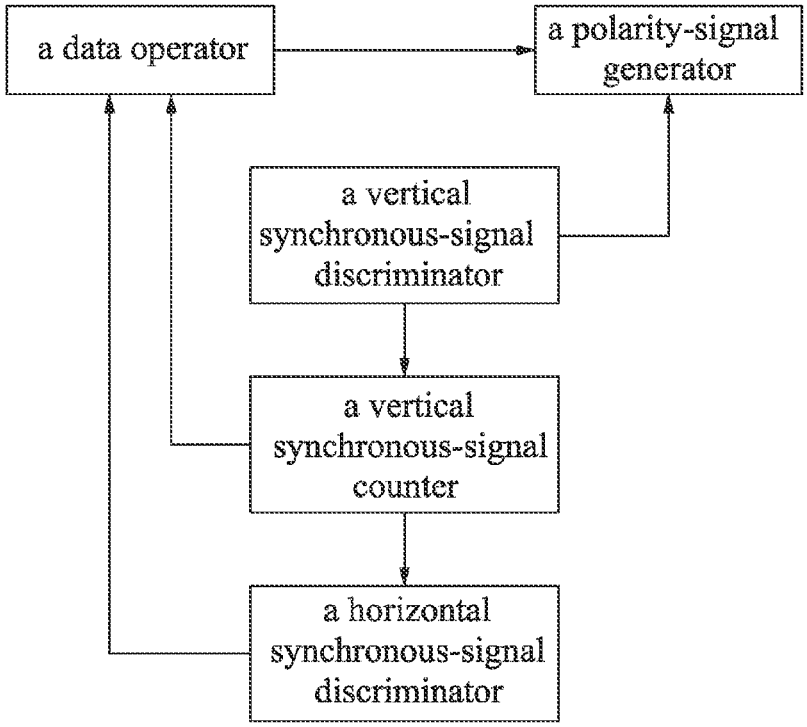
FIG. 3 is a schematic view of the driving system of the LCD apparatus in accordance with a second exemplary embodiment of the present invention.

As shown in FIG. 3, as same as the liquid crystal display of the first exemplary embodiment of the present invention, The driving system of the LCD apparatus of the second exemplary embodiment of the present invention also comprises a data-latching circuit, a synchronous-signal separating module, a data operator, a vertical synchronous-signal discriminator, a vertical synchronous-signal counter, horizontal synchronous-signal discriminator, and a polarity-signal generator. The data-latching circuit latches input data and correspondingly sends out an RGB data and data-enable signals to the data operator and the synchronous-signal separating module. The synchronous-signal separating module converts the data-enable signals into vertical synchronous signals and horizontal synchronous signals. The vertical synchronous-signal discriminator, the vertical synchronous-signal counter and the horizontal synchronous-signal discriminator are electrically coupled to the synchronous-signal separating module. The vertical synchronous-signal discriminator sends out a start signal to the polarity-signal generator when the vertical synchronous-signal discriminator judges the vertical synchronous signals exist. The vertical synchronous-signal counter accumulates an amount of the vertical synchronous signals and sends out an accumulated result to the data operator. The horizontal synchronous-signal discriminator sends out a start signal to the data operator when the horizontal synchronous-signal discriminator judges the horizontal synchronous signals exist. The data operator starts to operate after receiving the start signal sent out from the horizontal synchronous-signal discriminator, subtracts data of odd sub-pixels by data of even sub-pixels which are arranged in a horizontal line of the RGB data or subtracts data of the even sub-pixels by the odd sub-pixels, to obtain an Msum value, and then controls the polarity-signal generator to output polar-controlling signals corresponding to a scan line according to the Msum value and the accumulated result of the vertical synchronous-signal counter accumulating the amount of the vertical synchronous signals.

The driving system for the LCD apparatus of the second exemplary embodiment is as same as the first exemplary embodiment expects that a output terminal of the vertical synchronous-signal counter is electrically coupled to the horizontal synchronous-signal discriminator, there is another output terminal thereof is directly coupled to the data operator, and the accumulated result of the vertical synchronous-signal counter accumulating the amount of the vertical synchronous signals is directly sent out to the data operator.

A Third Exemplary Embodiment

Figure 4:
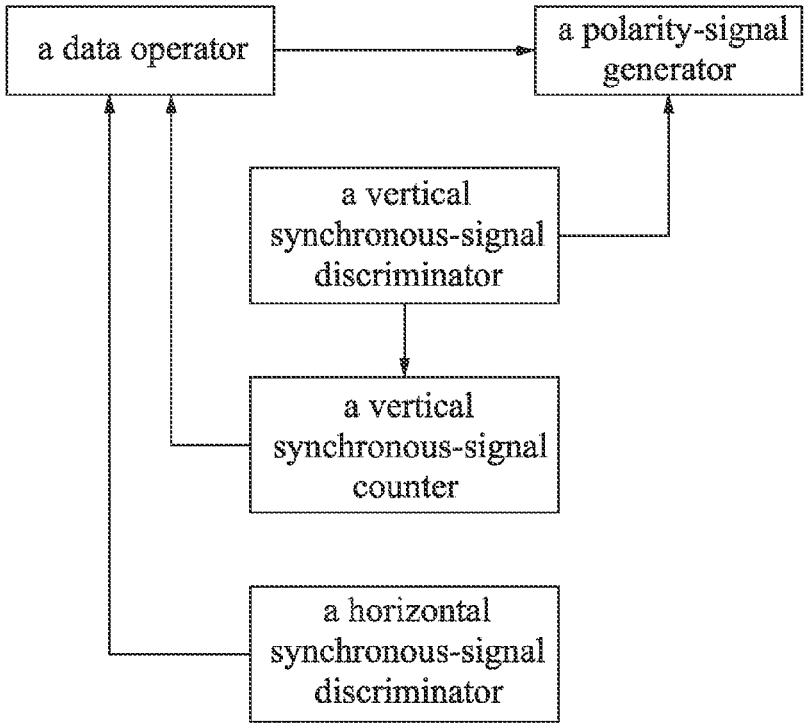
FIG. 4 is a schematic view of the driving system of the LCD apparatus in accordance with a third exemplary embodiment of the present invention.

As shown in FIG. 4, as same as the liquid crystal display of the first exemplary embodiment and the second exemplary embodiment of the present invention, The driving system of the LCD apparatus of the third exemplary embodiment of the present invention also comprises a data-latching circuit, a synchronous-signal separating module, a data operator, a vertical synchronous-signal discriminator, a vertical synchronous-signal counter, horizontal synchronous-signal discriminator, and a polarity-signal generator. The data-latching circuit latches input data and correspondingly sends out an RGB data and data-enable signals to the data operator and the synchronous-signal separating module. The synchronous-signal separating module converts the data-enable signals into vertical synchronous signals and horizontal synchronous signals. The vertical synchronous-signal discriminator, the vertical synchronous-signal counter and the horizontal synchronous-signal discriminator are electrically coupled to the synchronous-signal separating module. The vertical synchronous-signal discriminator sends out a start signal to the polarity-signal generator when the vertical synchronous-signal discriminator judges the vertical synchronous signals exist. The vertical synchronous-signal counter accumulates an amount of the vertical synchronous signals and sends out an accumulated result to the data operator. The horizontal synchronous-signal discriminator sends out a start signal to the data operator when the horizontal synchronous-signal discriminator judges the horizontal synchronous signals exist. The data operator starts to operate after receiving the start signal sent out from the horizontal synchronous-signal discriminator, subtracts data of odd sub-pixels by data of even sub-pixels which are arranged in a horizontal line of the RGB data or subtracts data of the even sub-pixels by the odd sub-pixels, to obtain an Msum value, and then controls the polarity-signal generator to output polar-controlling signals corresponding to a scan line according to the Msum value and the accumulated result of the vertical synchronous-signal counter accumulating the amount of the vertical synchronous signals.

The driving system for the LCD apparatus of the third exemplary embodiment is as same as the first exemplary embodiment and the second exemplary embodiment expect that an input terminal of the horizontal synchronous-signal discriminator and an output thereof is corresponding directly coupled to the synchronous-signal separating module and the data operator. An output terminal of the vertical synchronous-signal counter is electrically coupled to the horizontal synchronous-signal discriminator. The horizontal synchronous signals sent to horizontal synchronous-signal discriminator directly from synchronous-signal separating module, and the accumulated result of the vertical synchronous-signal counter accumulating the amount of the vertical synchronous signals is directly sent out to the data operator.

Figure 5:
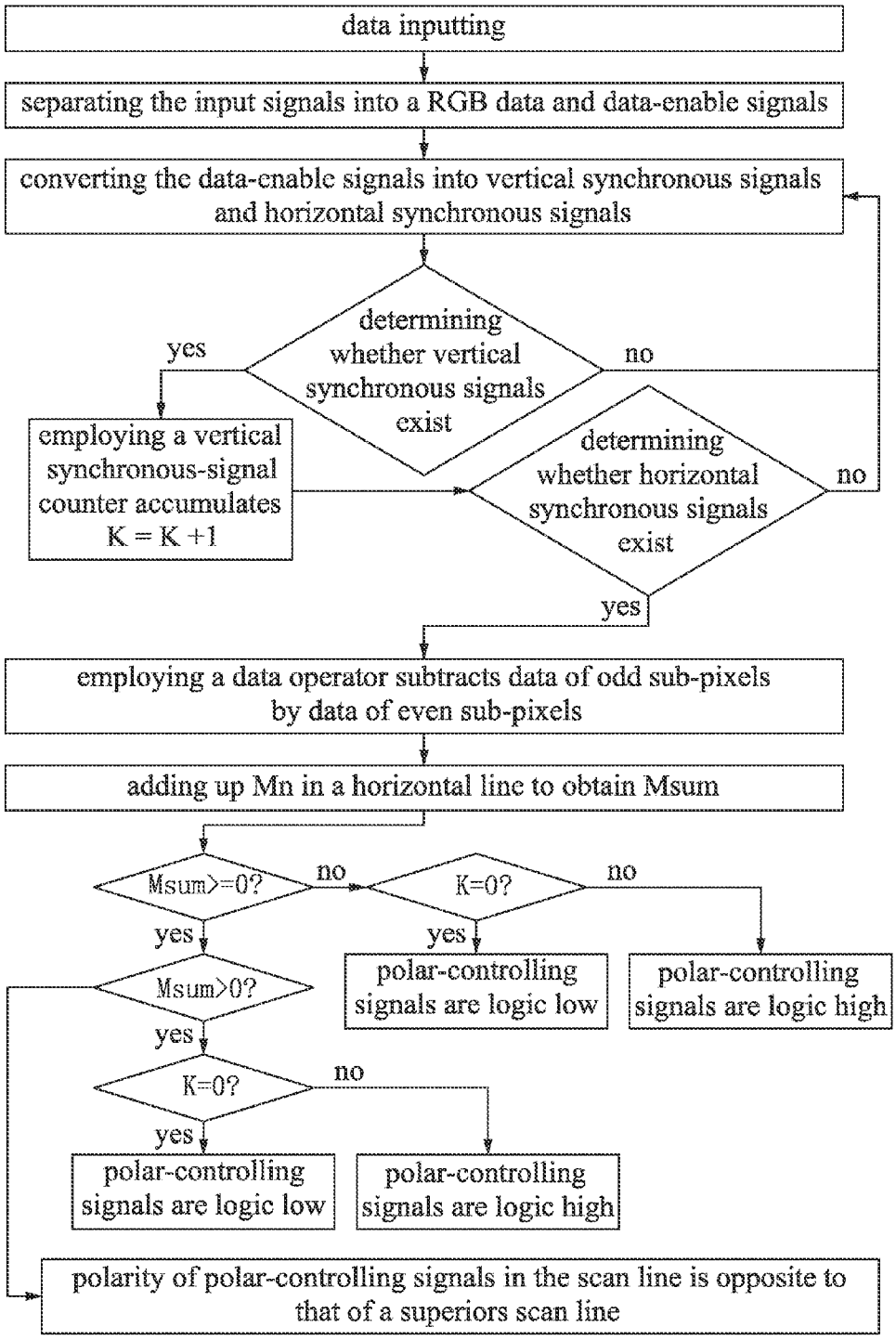
FIG. 5 is a schematic view of a liquid crystal display driving method in accordance with a first exemplary embodiment of the present invention.

As shown in FIG.5, a method thereof the driving system of LCD apparatus comprises steps of:

(1) employing a data-latching circuit latching an input signals and separating the input signals into an RGB data and data-enable signals;

(2) employing a synchronous-signal separating module converting the data-enable signals into vertical synchronous signals and horizontal synchronous signals;

(3) employing a vertical synchronous-signal discriminator determining whether vertical synchronous signals exist, and when the vertical synchronous-signal discriminator judges the vertical synchronous signals exist, then to step (4), otherwise return to step (1);

(4) the polarity-signal generator starting to work, and a vertical synchronous-signal counter accumulates an amount of the vertical synchronous signals, K =K +1;

(5) employing a horizontal synchronous signals discriminator determining whether horizontal synchronous signals exist, when the vertical synchronous-signal discriminator judges the vertical synchronous signals exist, then performing step (6), otherwise return to perform step (2);

(6) a data operator starting to work, to subtracts data of odd sub-pixels by data of even sub-pixels which are arranged in a horizontal line of the RGB data or subtracts data of the even sub-pixels by the odd sub-pixels, to obtain an Msum value, and determining a polarity of corresponding scan lines according the Msum value and K.

(7) a polarity-signal generator outputs polar-controlling signals according to a determination result of the data operator.

When Msum<0, K=0, the polar-controlling signals are logic low; when Msum<0, K≠0, the polar-controlling signals are logic high; when Msum>0, K=0, the polar-controlling signals are logic high; when Msum>0, K≠0, the polar-controlling signals are logic low; when Msum=0, K=0, polarity of the polar-controlling signals of a scan line is opposite with polarity of the polar-controlling signals of a previous scan line.

The vertical synchronous-signal counter accumulates in binary, and the vertical synchronous-signal counter accumulates the amount of the vertical synchronous signals, K=K+1, the K value is zero or 1 in turn.

When transmitting the RGB data, the data for two pixels are incoming once. Therefore, when employing the data operator to calculate the Msum value, it may firstly obtain an Mn value by subtracting the data of odd sub-pixels by the data of even sub-pixels of the two pixels once or subtracting the data of even sub-pixels by the data of odd sub-pixels of the two pixels once, Mn=DRn1−DGn1+DBn1−DRn2+DGn2−DBn2, or Mn=−DRn1+DGn1−DBn1+DRn2−DGn2+DBn2, and then add up the Mn value in the same horizontal line to obtain the Msum value, Msum=M1+M2+ . . . +Mn, n represents the times for transmitting data, n1 and n2 are corresponding to a first pixels and a second pixels of the data transmitted for the n times, DRn1 is a data value of the red pixels of n1 pixels, DGn1 is a data value of the green pixels of n1 pixels, DBn1 is a data value of the blue pixels of n1 pixels. Then, the Mn values in a horizontal line are added up, to obtain the Msum value.

In summary, the driving system and the driving method of the LCD apparatus of the present invention may employ the data-latching circuit latches the input data and separates the input data into the RGB data and the data-enable signals. The synchronous-signal separating module converts the data-enable signals into vertical synchronous signals and horizontal synchronous signals. The vertical synchronous-signal discriminator sends out a start signal to the polarity-signal generator when the vertical synchronous-signal discriminator judges the vertical synchronous signals exist. The vertical synchronous-signal counter accumulates an amount of the vertical synchronous signals and sends out an accumulated result to the data operator. The horizontal synchronous-signal discriminator sends out a start signal to the data operator when the horizontal synchronous-signal discriminator judges horizontal synchronous signals exist. The data operator starts to operate after receiving the start signal sent out from the horizontal synchronous-signal discriminator, subtracts the data of the odd sub-pixels by the data of the even sub-pixels which are arranged in a horizontal line of the RGB data or subtracts the data of the even sub-pixels by the data of the odd sub-pixels, to obtain the Msum value, and then determines the polarity of the corresponding scan line controls according to the Msum value and the accumulated result of the vertical synchronous-signal counter accumulating the amount of the vertical synchronous signals. The polarity-signal generator starts to operate after receiving the start signal, and output polar-controlling signals according to the determination result. The Msum value reflects the sum deviation of data of the entire scan line, which affects amounts of the entry line deviation from positive and negative polarity, and the Msum value is greater the sum deviation is more. Compare the Msum value with zero to determine whether polarity of a scan line and polarity of a next scan line is the same. If the polarity of the scan line and the polarity of the next scan line is the same, keep the same, and if the polarity of the scan line and the polarity of the next scan line is different, make the polarity of the scan line as same as the polarity of the next scan line, so that output of the data operation is not frequent switching polarity of positive and negative current, which reduces heat from source.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving system for a liquid crystal display (LCD) apparatus, comprising a data-latching circuit, a synchronous-signal separating module and a polarity-signal generator, the data-latching circuit being configured for separating input signals into RGB data and data-enable signals, the synchronous-signal separating module being configured for converting the data-enable signals into vertical synchronous signals and horizontal synchronous signals, wherein the driving system for the LCD apparatus further comprises a vertical synchronous-signal discriminator, a vertical synchronous-signal counter, a horizontal synchronous-signal discriminator and a data operator;

the vertical synchronous-signal discriminator, the vertical synchronous-signal counter and the horizontal synchronous-signal discriminator are electrically coupled to the synchronous-signal separating module;

the vertical synchronous-signal discriminator sends out a start signal to the polarity-signal generator if it judges there are the vertical synchronous signals;

the vertical synchronous-signal counter is configured for accumulating an amount of the vertical synchronous signals and sending out an accumulated result to the data operator;

the horizontal synchronous-signal discriminator sends out a start signal to the data operator if it judges there are the horizontal synchronous signals; and the data operator starts to operate after receiving the start signal sent out from the horizontal synchronous-signal discriminator, subtracts data of odd sub-pixels by data of even sub-pixels which are arranged in a horizontal line of the RGB data or subtracts data of the even sub-pixels by the odd sub-pixels, to obtain an Msum value, and then controls the polarity-signal generator to output polar-controlling signals corresponding to a scan line according to the Msum value and the accumulated result of the vertical synchronous-signal counter accumulating the amount of the vertical synchronous signals.

2. The driving system for the LCD apparatus according to claim 1, wherein an input terminal of the horizontal synchronous-signal discriminator is electrically coupled to the synchronous-signal separating module through the vertical synchronous-signal counter and the vertical synchronous-signal discriminator, and an output terminal thereof is electrically coupled to the data operator; and an output terminal of the vertical synchronous-signal counter electrically coupled to the data operator through the horizontal synchronous-signal discriminator.

3. The driving system for the LCD apparatus according to claim 1, wherein an input terminal of the horizontal synchronous-signal discriminator is electrically coupled to the synchronous-signal separating module through the vertical synchronous-signal counter and the vertical synchronous-signal discriminator, and an output terminal thereof is electrically coupled to the data operator; and an output terminal of the vertical synchronous-signal counter directly coupled to the data operator.

4. The driving system for the LCD apparatus according to claim 1, wherein an input terminal of the horizontal synchronous-signal discriminator is directly coupled to the synchronous-signal separating module, and an output thereof is directly coupled to the data operator;

an output terminal of the vertical synchronous-signal counter is directly coupled to the data operator.

5. The driving system for the LCD apparatus according to claim 4, wherein the vertical synchronous-signal counter accumulates in binary.

6. A driving method for a liquid crystal display (LCD) apparatus comprising steps of:

(1) employing a data-latching circuit to latch input signals and separating the input signals into RGB data and data-enable signals;

(2) employing a synchronous-signal separating module to convert the data-enable signals into vertical synchronous signals and horizontal synchronous signals;

(3) employing a vertical synchronous-signal discriminator to determine whether the vertical synchronous signals exist, and if the vertical synchronous signals exist, then performing step (4), otherwise returning to perform step (1);

(4) starting a polarity-signal generator to operate, and employing a vertical synchronous-signal counter to accumulate an amount of the vertical synchronous signals, $K = K + 1$;

(5) employing a horizontal synchronous-signal discriminator to determine whether horizontal synchronous signals exist, if the horizontal synchronous signals exist, then performing step (6), otherwise returning to perform step (2);

(6) starting a data operator to operate, and subtract data of odd sub-pixels by data of even sub-pixels which are arranged in a horizontal line of the RGB data or subtract data of the even sub-pixels by the odd sub-pixels, to obtain an Msum value, and determining polarity of corresponding scan lines according the Msum value and K; and (7) employing a polarity-signal generator to output polar-controlling signals according to a determination result of the data operator.

7. The driving method for LCD apparatus according to claim 6, wherein the vertical synchronous-signal counter accumulates in binary.

8. The driving method for the LCD apparatus according to claim 7, wherein:

When $Msum < 0$, $K = 0$, the polar-controlling signals are logic low; when $Msum < 0$, $K \neq 0$, the polar-controlling signals are logic high; when $Msum > 0$, $K = 0$, the polar-controlling signals are logic high; when $Msum > 0$, $K \neq 0$, the polar-controlling signals are logic low; when $Msum = 0$, $K = 0$, polarity of the polar-controlling signals of a scan line is opposite with the polarity of the polar-controlling signals of a previous scan line.

9. The driving method for the LCD apparatus according to claim 7, wherein positive voltage is applied to the odd sub-pixels, the negative voltage is applied to the even sub-pixels, and the data operator subtracts data of even sub-pixels by data of odd sub-pixels which are arranged in a horizontal line of the RGB data to obtain the Msum value, and compare the Msum value with zero to determine whether polarity of a scan line and polarity of a next scan line is the same, if the polarity of the scan line and the polarity of the next scan line is the same, the positive voltage is applied to the even sub-pixels, the negative voltage is applied to the odd sub-pixels, and if the polarity of the scan line and the polarity of the next scan line is different, the negative voltage is applied to the even sub-pixels, the positive voltage is applied to the even sub-pixels.

10. The driving method for LCD apparatus according to claim 9, wherein when the data operator accumulates the Msum value, the data operator substrates data of even sub-pixels by data of odd sub-pixels of inputting two pixels to obtain an Mn value, then adds up the Mn value in a horizontal line to obtain the Msum value; wherein n represents the times for transmitting data.

11. The driving method for the LCD apparatus according to claim 7, wherein positive voltage is applied to the even sub-pixels, the negative voltage is applied to the odd sub-pixels, and the data operator subtracts data of even sub-pixels by data of odd sub-pixels which are arranged in a horizontal line of the RGB data to obtain the Msum value, and compare the Msum value with zero to determine whether the polarity of a scan line and polarity of a next scan line is the same, if the polarity of the scan line and the polarity of the next scan line is the same, the negative voltage is applied to the even sub-pixels, the positive voltage is applied to the odd sub-pixels, and if the polarity of the scan line and the polarity of the next scan line is different, the positive voltage is applied to the even sub-pixels, the negative voltage is applied to the even sub-pixels.

12. The driving method for the LCD apparatus according to claim 11, wherein when the data operator accumulates the Msum value, the data operator substrates data of even sub-pixels by data of odd sub-pixels of inputting two pixels to obtain an Mn value, then adds up the Mn value in a horizontal line to obtain the Msum value; wherein n represents the times for transmitting data.

13. A driving system for a liquid crystal display (LCD) apparatus, wherein the driving system for the LCD apparatus comprises:

a data-latching circuit, configured for separating input signals into RGB data and a data-enable signals;

a synchronous-signal separating module, electrically coupled to the data-latching circuit, to convert the data-enable signals into vertical synchronous signals and horizontal synchronous signals;

a vertical synchronous-signal discriminator, electrically coupled to the synchronous-signal separating module, to determine whether the vertical synchronous signals exist;

a vertical synchronous-signal counter, electrically coupled to the vertical synchronous-signal discriminator, to accumulates an amount of the vertical synchronous signals and send out an accumulated result to the data operator;

a horizontal synchronous-signal discriminator, configured for determining whether the horizontal synchronous signals exist, and sending out a start signal when the horizontal synchronous-signal discriminator determines the horizontal synchronous signals exist;

a data operator, electrically coupled to the horizontal synchronous-signal discriminator, to start to operate after receiving the start signal sent out from the horizontal synchronous-signal discriminator, and subtract data of odd sub-pixels by data of even sub-pixels which are arranged in a horizontal line of the RGB data or subtract data of the even sub-pixels by the odd sub-pixels, to obtain an Msum value, and then determine polarity of corresponding a scan line according to the Msum value and the accumulated result of the vertical synchronous-signal counter accumulating the amount of the vertical synchronous signals; and a polarity-signal generator, electrically coupled to the data operator, to output polar-controlling signals according to the determination result of the data operator.

14. The driving system for the LCD apparatus according to claim 13, wherein the horizontal synchronous signals is sent out from the synchronous-signal separating module through the vertical synchronous-signal discriminator and the vertical synchronous-signal counter to the horizontal synchronous-signal discriminator, and the accumulated result of the vertical synchronous-signal counter accumulating the amount of the vertical synchronous signals is sent out from the horizontal synchronous-signal discriminator to the data operator.

15. The driving system for the LCD apparatus according to claim 13, wherein the accumulated result of the vertical synchronous-signal counter accumulating the amount of the vertical synchronous signals is directly sent out to the data operator.

16. The driving system for the LCD apparatus according to claim 13, wherein the horizontal synchronous signals is directly sent out from the synchronous-signal separating module to the horizontal synchronous-signal discriminator, and the accumulated result of the vertical synchronous-signal counter accumulating the amount of the vertical synchronous signals is sent out from the horizontal synchronous-signal discriminator to the data operator.

17. The driving system for the LCD apparatus according to claim 13, wherein the vertical synchronous-signal counter accumulates in binary.

* * * * *